US006426724B2

(12) United States Patent
Gunee et al.

(10) Patent No.: US 6,426,724 B2
(45) Date of Patent: Jul. 30, 2002

(54) ANTENNA CONNECTOR

(75) Inventors: Anders Gunee, Lund (SE); Heikki Laaksonen, Salo (FI)

(73) Assignee: Nokia Mobile Phones Limited, Espoo (FI)

( * ) Notice: Subject to any disclaimer, the term of this patent is extended or adjusted under 35 U.S.C. 154(b) by 0 days.

(21) Appl. No.: 09/804,197

(22) Filed: Mar. 13, 2001

(30) Foreign Application Priority Data

Mar. 16, 2000 (GB) ..... 0006418

(51) Int. Cl.[7] ..... H01Q 1/24

(52) U.S. Cl. ..... 343/702; 343/700 MS; 343/906

(58) Field of Search ..... 343/702, 700 MS, 343/741, 866, 870, 906; 439/698, 571, 62, 83

(56) References Cited

U.S. PATENT DOCUMENTS 5,490,788 A 2/1996 Mazzochette ..... 439/83
5,496,182 A 3/1996 Yasumura ..... 439/62
6,109,962 A * 8/2000 Chen-Shiang ..... 439/571
6,149,470 A * 11/2000 Northey et al. ..... 343/702

FOREIGN PATENT DOCUMENTS

EP 0902508 3/1999 ..... H01R/23/72

* cited by examiner

*Primary Examiner*—Don Wong
*Assistant Examiner*—Hoang Nguyen
(74) *Attorney, Agent, or Firm*—Antonelli, Terry, Stout & Kraus, LLP

(57) ABSTRACT

An antenna connector for holding an antenna in relation to a printed circuit board, where the antenna connector has means for releasable holding the antenna onto the printed circuit board. The holding means of the antenna connector are constructed to enable easy removal of the antenna from the printed circuit board so that components placed under antenna can be reached, repaired or replaced, and that the characteristics of a radio part on the printed circuit board can be measured without having the antenna mounted.

72 Claims, 4 Drawing Sheets

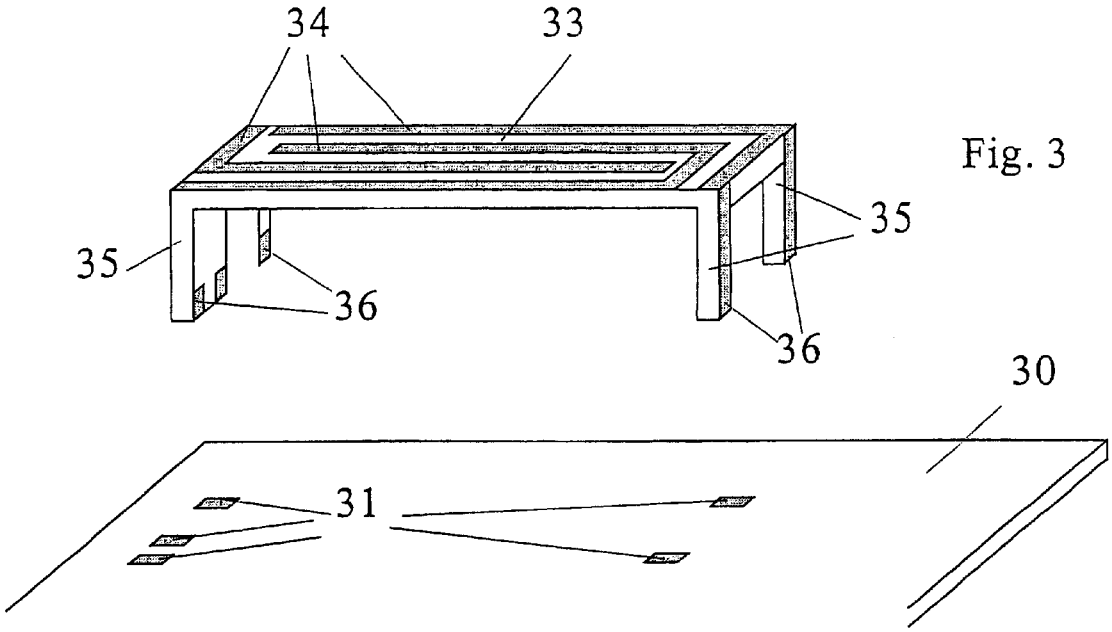
Fig. 3
Fig. 4
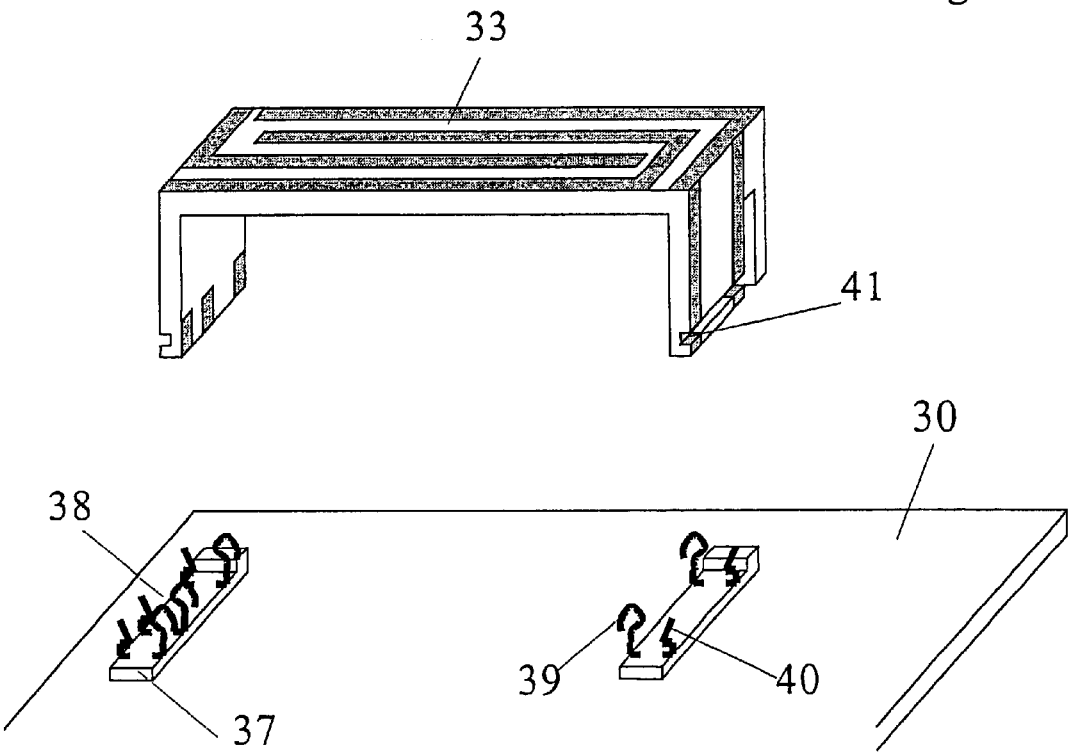

ANTENNA CONNECTOR

BACKGROUND OF THE INVENTION

The invention relates to an antenna connector for holding an antenna and a printed circuit board in relation to each other so that there is contact between the antenna and the printed circuit board.

Electronic devices, e.g. mobile telephones, are getting smaller and smaller along with the present technological development. This means that all the components in the electronic devices also need to get smaller and smaller and more and more integrated. These electronic devices have a printed circuit board, whereon electronic components are mounted during a pick and place process.

When the antenna device becomes smaller and smaller it is desired to place the device directly onto the printed circuit board during the pick and place process. The cheapest and the most robust solution would be to solder the antenna devices onto the printed circuit board. However for mobile phones there is need for optimising the performance of the radio transmitter and receiver. Therefore it is desired to allow automatical testing of the performance during the testing. However it is not possible to test the RF stage output when the antenna device is soldered directly onto the printed circuit board.

In the latest mobile phones there is also a need for having more connections between the radio part and the antenna due to the fact that most mobile phones are now working in two frequency bands and in the future they will probably use even more frequency bands.

SUMMARY OF THE INVENTION

An object of the invention is to provide an antenna connector that enables that measurements for controlling the characteristics of a radio part on a printed circuit board can easily be conducted without breaking the antenna and that the components mounted beneath the antenna can on a later occasion be reached for repairing or checking without breaking the antenna.

According to claimed invention this objective is obtained by an antenna connector for holding an antenna in relation to a printed circuit board, where the antenna connector has means for releasable holding of the antenna onto the printed circuit board and that the holding means of the antenna connector are constructed to enable later flexible removal of the antenna.

An object of the invention is to provide a communication unit having a printed circuit board provided with an antenna connector for holding an antenna in relation to a printed circuit board, enabling easy removal of the antenna and availability to components mounted beneath the antenna.

According to the claimed invention a communication unit provided with an antenna connector for holding an antenna in relation to a printed circuit board, where the antenna connector has means for releasable holding of the antenna onto the printed circuit board, and that the holding means of the antenna connector are constructed to enable later flexible removal of the antenna.

BRIEF DESCRIPTION OF THE DRAWINGS

The invention will be explained more fully below, by way of example, in connection with preferred embodiments and with reference to the drawing, in which:

FIG. 3 shows an antenna that will be soldered onto the printed circuit board.

FIG. 4 shows an antenna that will attached to the printed circuit board by an antenna connector.

DETAILED DESCRIPTION OF THE INVENTION

Figure 1:
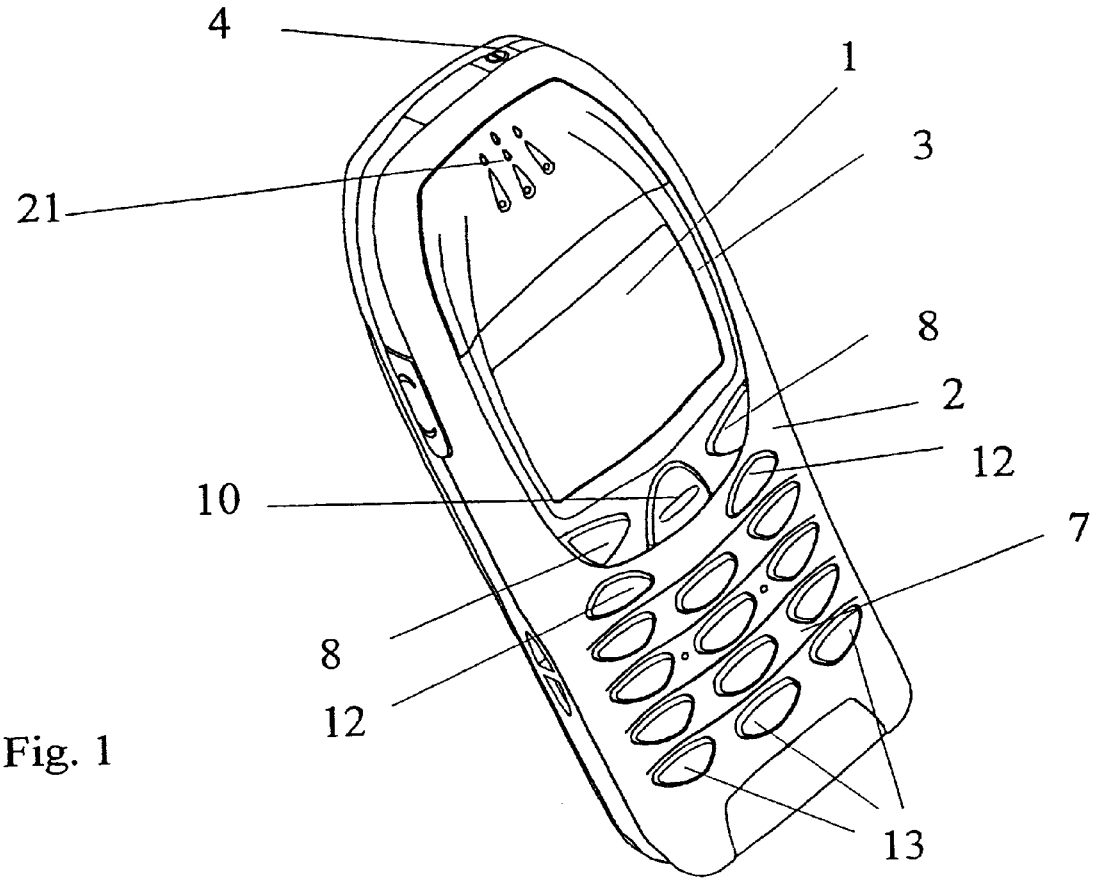
FIG. 1 shows in a perspective view a preferred embodiment of the communication unit according to the invention.

According to a first aspect the antenna connector according to the invention will be described with reference to a hand portable phone, preferably a cellular/mobile phone. A preferred embodiment of this phone is shown in FIG. 1, where a phone is shown in perspective. As will be seen, the phone is provided with a front cover 2 having a window frame 3 encircling the protection window of the display assembly 1. The phone comprises a user interface having an on/off button 4, a keyboard/keypad 7, a battery, a display/LCD 1, an ear-piece 21 and a microphone 22 (not shown).

The keyboard/keypad 7 has a first group of keys 13 as alphanumeric keys, by means of which the user can enter a telephone number, write a text message (SMS), write a name (associated with the phone number), etc. Each of the twelve alphanumeric keys 13 is provided with a figure "0–9" or a sign "#" or "*", respectively. In alpha mode each key is associated with a number of letters and special signs used in the text editing.

The keyboard/keypad 7 additionally comprises two soft keys 8, two call handling keys 12, and a navigation key 10. The functionality of the soft key depends on the state of the phone and the navigation in the menu by using a navigation key. The present functionality of the soft keys 8 is shown in separate fields in the display 1 just above the keys 8. The two call handling keys 12 are used for establishing a call or a conference call, terminating a call or rejecting an incoming call.

The navigation key 10 is an up/down key and is placed centrally on the front surface of the phone between the display 1 and the group of alphanumeric keys 13. Hereby the user will be able to control this key with his thumb. This is the best site to place an input key requiring precise motor movements. Many experienced phone users are used to one-hand handling. They place the phone in the hand between the fingertips and the palm of the hand. Hereby the thumb is free for inputting information.

Figure 2:
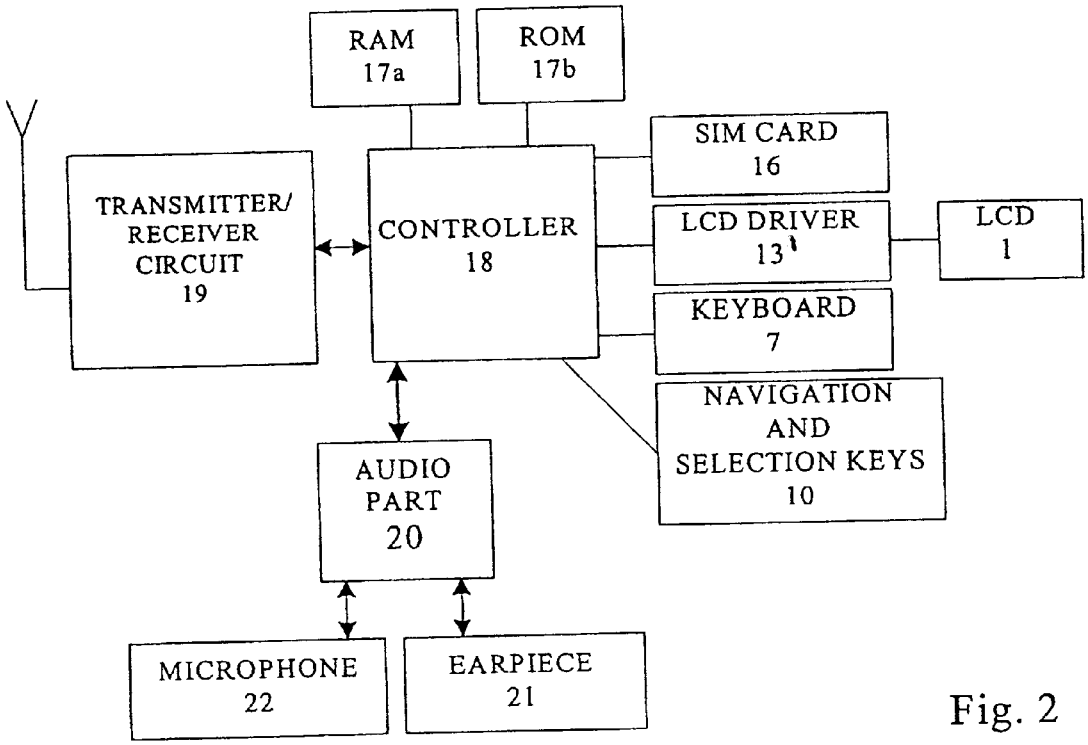
FIG. 2 schematically shows the essential parts of a telephone for communication with a cellular network.

FIG. 2 schematically shows the most important parts of a preferred embodiment of the phone, said parts being essential to the understanding of the invention. The microphone 22 records the user's speech, and the analogue signals formed thereby are A/D converted in an A/D converter (not shown) before the speech is encoded in an audio part 20. The encoded speech signal is transferred to the controller 18 (physical layer processor), which e.g. supports the GSM terminal software. The controller 18 also forms the interface to the peripheral units of the apparatus, including RAM and ROM memories 17*a* and 17*b*, a SIM card 16, the display 1 and the keyboard/keypad 7 (from FIG. 1) as well as data, power supply, etc. The controller 18 communicates with the transmitter/receiver circuit 19. The audio part 20 speechdecodes the signal, which is transferred from the controller 18 to the ear-piece 21 via a D/A converter (not shown).

The preferred embodiment of the phone of the invention is adapted for use in connection with the GSM network, but, of course, the invention may also be applied in connection with other phone networks. It could be cellular networks, various forms of cordless phone systems or in dual band phones accessing sets of these systems/networks.

The controller 18 is connected to the user interface. Thus, it is the controller 18, which monitors the activity in the phone and controls the display 1 in response thereto.

Therefore, it is the controller 18, which detects the occurrence of a state change event and changes the state of the phone and thus the display text. The user may cause a state change event, when he/she activates the keyboard/keypad 7 including the navigation key or keys 10, and these type of events are called entry events or user events. However, the network communicating with the phone may also cause a state change event. These type of events and other events beyond the user's control are called non-user events. Non user events comprise status change during call set-up, change in battery voltage, change in antenna conditions, message on reception of SMS, etc.

The invention will be described in some examples with reference to FIGS. 3 to 7 showing the various features of an antenna connector.

In FIG. 3 a printed circuit board 30 is shown having contact pads 31, and an antenna 33. The antenna includes several transmitting and receiving antennas 34. It also includes legs 35. The different transmitting and receiving antennas 34 have parts 36 that extends along the legs 35 of the antenna to enable contact with the contact pads 31 on the printed circuit board 30. The extending parts 36 extend down over the end of the legs 35 and up on the other side of the legs 35. This construction enables better contact between the antenna 33 and the printed circuit board 30. The antenna 33 shown in FIG. 3 is soldered onto the printed circuit board 30.

Another solution for attaching an antenna 33 to a printed circuit board 30 is shown in FIG. 4, where the antenna 33 is attached to the printed circuit board 30 having an antenna connector 37 mounted, preferably by soldering, on the printed circuit board 30. The antenna connectors 37 includes contact members 38 mounted in slots (not shown) on the antenna connector 37, where each contact member 38 includes two contact parts 39 and 40. The first contact part 39 has mainly a contact function, while the second contact part 40 also has a holding function. When an antenna 33 is placed in the connector 37, between the two contact parts 39 and 40, the second contact part 40 will snap into a recession 41 on the antenna 33. The second contact part 40 will hold the antenna 33 firmly so that a good contact is established between the antenna 33 and the printed circuit board 30. If the antenna 33 needs be removed due to maintenance of components placed beneath (not shown) the antenna 33 or that testing of a radio part (not shown) on the printed circuit board 30 and connected to the antenna, the second contact parts 40 can easily be bent outwards from the antenna 33 thus releasing the antenna 33 from the antenna connector 37.

Figure 5:
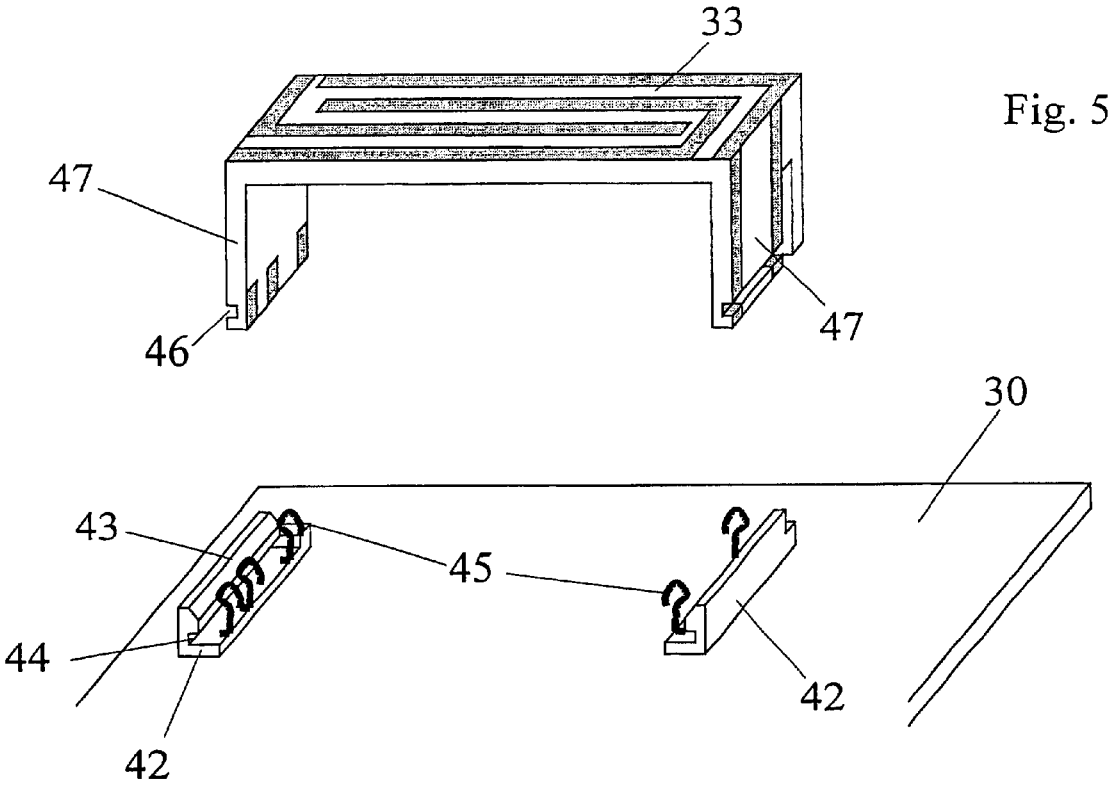
FIG. 5 shows an antenna that will attached to the printed circuit board by another antenna connector.

In FIG. 5 is yet another way of attaching an antenna 33 to a printed circuit board 30 shown, where antenna connectors 42 having a raised section 43 are mounted, preferably by soldering, onto the printed circuit board 30. The raised section 43 of the antenna connector 42 has a recession 44, which overlaps with a corresponding recession 46 on the antenna 33. The antenna connector 42 also includes contact members 45 mounted in slots (not shown) on the antenna connector 42, where the part of the contact members 45 having contact with the antenna 33 has a closed end or at least an end pointing downwards. Any metal parts in the antenna connector 42 will affect the antenna 33, but having a closed end or at least an end pointing downwards minimises the effect from the antenna connector 42 on the antenna 33.

In FIG. 5 are shown antenna connectors 42 having three and two contact members 45 respectively. To enable the antenna connectors 42 to receive different types of antennas 33 with different numbers of antenna parts the antenna connectors 42 are provided with numerous slots (not shown). For every different type of antenna 33 the antenna connector 42 will be provided with a suitable number of contact members 45, while the rest of the slots will be empty. Also the embodiments shown in FIG. 4 and 6 are provided with numerous slots to adapt to different types of antennas 33.

When an antenna 33 is placed in the antenna connector 42 the contact members 45 will be bend outwards from the raised section 43 until the recession 46 on the antenna 33 snaps into the recession 44 on the antenna connector 42. The contact between the contact members 45 and the antenna 33 is earlier shown described with reference to FIG. 3. The antenna 33 is released by pressing the legs 47 inwards and thereby pushing the contact members 45 away, releasing the snapped recessions 44 and 46, and thereafter lifting the antenna 33.

Figure 6:
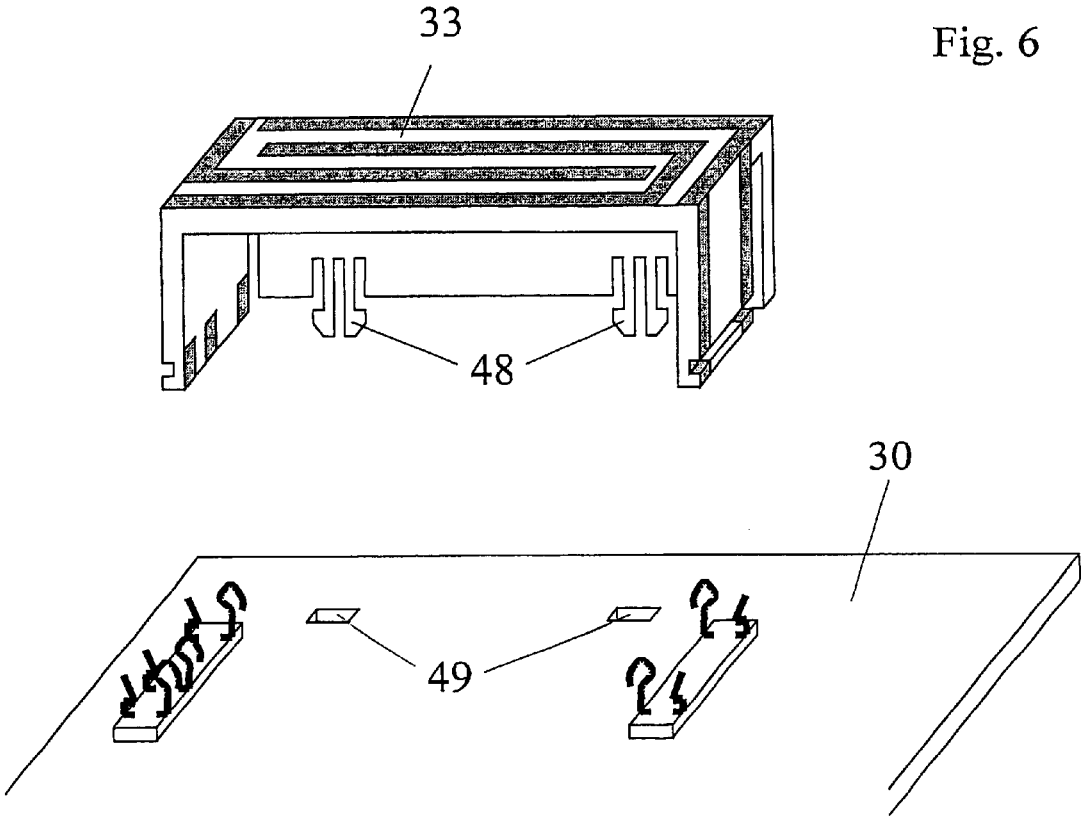
FIG. 6 shows an antenna assembly having extra holding means for attaching the antenna to the printed circuit board.

In FIG. 6 is shown an antenna 33 having extra holding means 48 for increasing the attaching force between the antenna 33 and the printed circuit board 30. The extra holding means 48 includes snapping members that are inserted in recessions 49 on the printed circuit board 30, when mounting the antenna 33 onto the printed circuit board 30.

Figure 7:
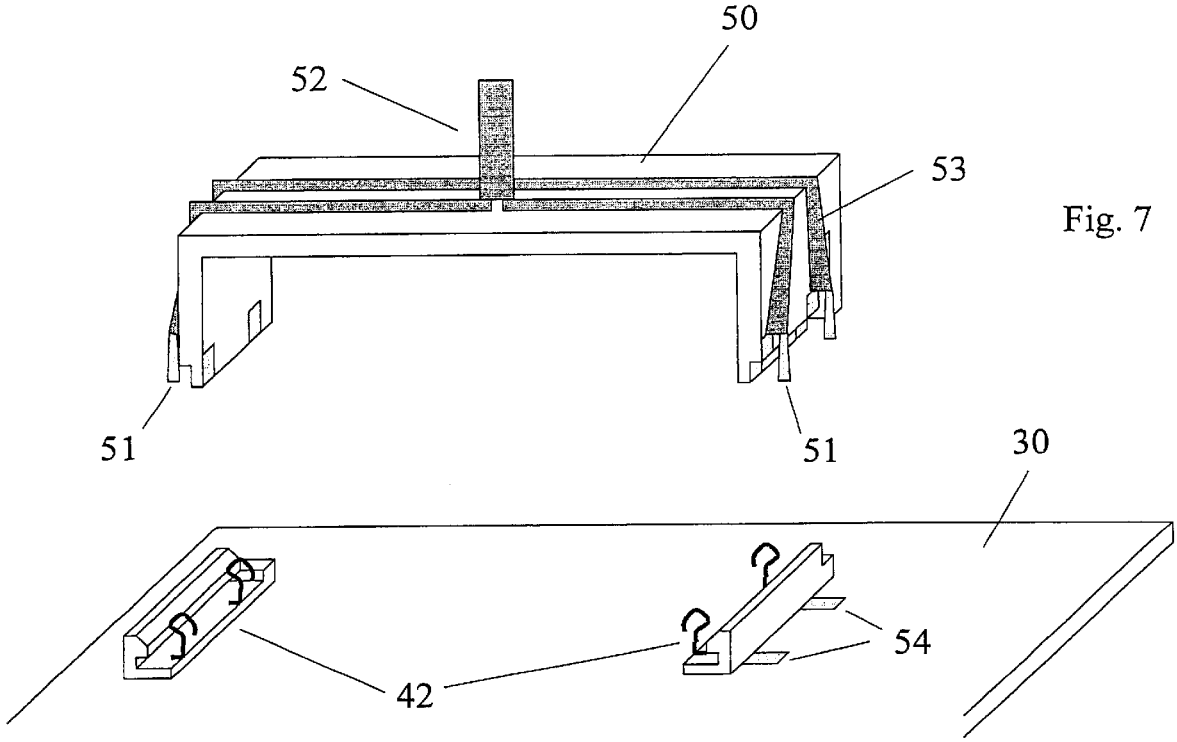
FIG. 7 shows a schematic view of an antenna probe for conducting measurements and the antenna connector.

In FIG. 7 is shown a schematic view of an antenna probe 50 for testing a radio part (not shown) on the print circuit board 30. The antenna probe 50 has some contact cables 52 for connecting to measuring equipment (not shown) and some coax cables 53 to attach to some grounding pins 51. As mentioned earlier there is a need for testing the radio part of a mobile phone to see that the radio parts meet the requirements of certain standards or just to check if the performance of the radio part is satisfactory. The antenna probe 50 has in this example a similar structure to that of the earlier described antennas 33, but it could have any other design as long as the grounding pins 51 fits into the antenna connector 42 and that they are connected to some grounding pads 54. The antenna probe 50 lacks any recessions that corresponds to the recessions 44 of the antenna connector 42 (FIG. 5) or that the second contact part 40 (shown in FIG. 4), which snaps into the recessions and holds the antenna probe 50 firmly to the printed circuit board 30. This enables the antenna probe 50 to easily be placed in the antenna connector 37 or 42, and that tests can be conducted on the radio part.

The antenna probe 50 and the antenna 33 can be held and placed in the antenna connector 42 by the same rotating tool (not shown). While the antenna probe 50 is placed onto the antenna connector 42 for conducting the tests the antenna 33 can be held in another position waiting to be placed onto the antenna connector 42 after the tests have been completed. The rotating tool lifts the antenna probe 50 and rotates so that the antenna 33 is placed in the mounting position and thereafter placed onto the antenna connector 42.

The invention is not limited to the above-described examples or to the drawings showing examples of an embodiment, but can be varied within the scope of the appended claims.

What is claimed is:

1. An antenna connection for releasably holding an antenna, including a recess, to a printed circuit board comprising:

an antenna connector which is electrically connected to the printed circuit board and includes a recess; and electrically conductive contact members attached to the antenna connector which engage the antenna to provide electrical contact between the antenna and the antenna connector; and wherein the recess of the antenna engages the antenna connector and the recess of the antenna connector engages the antenna when the antenna is releasably held by the antenna connector.

2. An antenna connection in accordance with claim 1 wherein:

the antenna connector includes slots which hold the contact members; and the antenna connector is soldered to the circuit board.

3. An antenna connection in accordance with claim 2 wherein:

the contact members are flexible and are bent during attachment of the antenna to the elongated antenna connector.

4. An antenna connection in accordance with claim 3 comprising:

at least one connection member releasably attaching the antenna directly to the printed circuit board.

5. An antenna connection in accordance with claim 2 wherein when the antenna is releasably held by the antenna connector:

the contact members have a closed end part which provides electrical connection to contact locations on the antenna and contact with contact pads on the printed circuit board through the slots.

6. An antenna connection in accordance with claim 5 wherein:

the antenna connector includes a number of slots greater than a number of contact members with some of the slots holding contact members contacting the contact pads.

7. An antenna connection in accordance with claim 6 comprising:

at least one connection member releasably attaching the antenna directly to the printed circuit board.

8. An antenna connection in accordance with claim 5 comprising:

at least one connection member releasably attaching the antenna directly to the printed circuit board.

9. An antenna connection in accordance with claim 2 comprising:

at least one holding member releasably attaching the antenna directly to the printed circuit board.

10. An antenna connection in accordance with claim 1 wherein:

the contact members are flexible and are bent during attachment of the antenna to the antenna connector.

11. An antenna connection in accordance with claim 10 wherein when the antenna is releasably held by the antenna connector:

the contact members have a closed end part which provides electrical connection to contact locations on the antenna and contact with contact pads on the printed circuit board through the slots.

12. An antenna connection in accordance with claim 11 comprising:

at least one connection member releasably attaching the antenna dierectly to the printed circuit board.

13. An antenna connection in accordance with claim 10 comprising:

at least one connection member releasably attaching the antenna directly to the printed circuit board.

14. An antenna connection in accordance with claim 1 comprising:

at least one connection member releasably attaching the antenna directly to the printed circuit board.

15. An antenna connection in accordance with claim 1 wherein:

the antenna connector includes a connection which receives a testing probe.

16. An antenna connection in accordance with claim 1 wherein:

the antenna connection is elongated.

17. An antenna connection for releasably holding an antenna, including a recess, to a printed circuit board comprising:

an antenna connector which is electrically connected to the printed circuit board; and electrically conductive contact members attached to the antenna connection which engage the antenna to provide electrical contact between the antenna and antenna connection; and wherein at least one of the contact members projects into the recess of the antenna to hold the antenna when the antenna is releasably held by the elongated antenna connector.

18. An antenna connection in accordance with claim 17 wherein:

the antenna connector includes slots which hold the contact members; and the antenna connector is soldered to the circuit board.

19. An antenna connection in accordance with claim 18 wherein:

at least one of the contact members engages the antenna at a point of contact thereon which is not the recess of the antenna.

20. An antenna connection in accordance with claim 19 wherein:

the contact members are flexible and are bent during attachment of the antenna to the antenna connector.

21. An antenna connection in accordance with claim 20 wherein:

the contact members have a closed end part which provides electrical connection to contact locations on the antenna and are in contact with contact pads on the printed circuit board through the slots.

22. An antenna connection in accordance with claim 19 wherein:

the contact members have a closed end part which provides electrical connection to contact locations on the antenna and are in contact with contact pads on the printed circuit board through the slots.

23. An antenna connection in accordance with claim 18 wherein:

the contact members are flexible and are bent during attachment of the antenna to the antenna connector.

24. An antenna connection in accordance with claim 23 wherein:

the contact members have a closed end part which provides electrical connection to contact locations on the antenna and are in contact with contact pads on the printed circuit board through the slots.

25. An antenna connection in accordance with claim 18 wherein:

the contact members have a closed end part which provides electrical connection to contact locations on the antenna and are in contact with contact pads on the printed circuit board through the slots.

26. An antenna connection in accordance with claim 17 wherein:

at least one of the contact members engages the antenna at a point of contact thereon which is not the recess of the antenna.

27. An antenna connection in accordance with claim 26 wherein:

the contact members are flexible and are bent during attachment of the antenna to the antenna connector.

28. An antenna connection in accordance with claim 27 wherein:

the contact members have a closed end part which provides electrical connection to contact locations on the antenna and are in contact with contact pads on the printed circuit board through the slots.

29. An antenna connection in accordance with claim 26 wherein:

the contact members have a closed end part which provides electrical connection to contact locations on the antenna and are in contact with contact pads on the printed circuit board through the slots.

30. An antenna connection in accordance with claim 17 wherein:

the contact members are flexible and are bent during attachment of the antenna to the antenna connector.

31. An antenna connection in accordance with claim 30 wherein:

the contact members have a closed end part which provides electrical connection to contact locations on the antenna and are in contact with contact pads on the printed circuit board through the slots.

32. An antenna connection in accordance with claim 17 wherein:

the contact members have a closed end part which provides electrical connection to contact locations on the antenna and are in contact with contact pads on the printed circuit board through the slots.

33. An antenna connection in accordance with claim 17 wherein:

the antenna connector includes a number of slots greater than a number of contact members with some of the slots holding contact members contacting the contact pads.

34. An antenna connection in accordance with claim 17 wherein:

the antenna connector includes a number of slots greater than a number of contact members with some of the slots holding contact members contacting the contact pads.

35. An antenna connection in accordance with claim 17 wherein:

the antenna connector includes a connection which receives a testing probe.

36. An antenna connection in accordance with claim 17 wherein:

the antenna connection is elongated.

37. A communication unit provided with an antenna connection for releasably holding an antenna, including a recess, to a printed circuit board, the antenna connection comprising:

an antenna connector which is electrically connected to the printed circuit board and includes a recess; and electrically conductive contact members attached to the antenna connector which engage the antenna to provide electrical contact between the antenna and the antenna connector; and wherein the recess of the antenna engages the antenna connector and the recess of the antenna connector engages the antenna when the antenna is releasably held by the antenna connector.

38. A communication unit in accordance with claim 37 wherein:

the antenna connector includes slots which hold the contact members; and the antenna connector is soldered to the circuit board.

39. A communication unit in accordance with claim 38 wherein:

the contact members are flexible and are bent during attachment of the antenna to the elongated antenna connector.

40. A communication unit in accordance with claim 39 comprising:

at least one connection member releasably attaching the antenna directly to the printed circuit board.

41. A communication unit in accordance with claim 38 wherein when the antenna is releasably held by the antenna connector:

the contact members have a closed end part which provides electrical connection to contact locations on the antenna and contact with contact pads on the printed circuit board through the slots.

42. A communication unit in accordance with claim 41 wherein:

the antenna connector includes a number of slots greater than a number of contact members with some of the slots holding contact members contacting the contact pads.

43. A communication unit in accordance with claim 42 comprising:

at least one connection member releasably attaching the antenna directly to the printed circuit board.

44. A communication unit in accordance with claim 41 comprising:

at least one connection member releasably attaching the antenna directly to the printed circuit board.

45. A communication unit in accordance with claim 38 comprising:

at least one holding member releasably attaching the antenna directly to the printed circuit board.

46. A communication unit in accordance with claim 37 wherein:

the contact members are flexible and are bent during attachment of the antenna to the antenna connector.

47. A communication unit in accordance with claim 46 wherein when the antenna is releasably held by the antenna connector:

the contact members have a closed end part which provides electrical connection to contact locations on the antenna and contact with contact pads on the printed circuit board through the slots.

48. A communication unit in accordance with claim 47 comprising:

at least one connection member releasably attaching the antenna directly to the printed circuit board.

49. A communication unit in accordance with claim 46 comprising:

at least one connection member releasably attaching the antenna directly to the printed circuit board.

50. A communication unit in accordance with claim 37 comprising:

at least one connection member releasably attaching the antenna directly to the printed circuit board.

51. A communication unit in accordance with claim 37 wherein:

the antenna connector includes a connection which receives a testing probe.

52. A communication unit in accordance with claim 37 wherein:

the antenna connection is elongated.

53. A communication unit provided with an antenna for releasably holding an antenna, including a recess, to a printed circuit board, the antenna connection comprising:

an antenna connector which is electrically connected to the printed circuit board; and electrically conductive contact members attached to the antenna connection which engage the antenna to provide electrical contact between the antenna and antenna connection; and wherein at least one of the contact members projects into the recess of the antenna to hold the antenna when the antenna is releasably held by the elongated antenna connector.

54. A communication unit in accordance with claim 53 wherein:

the antenna connector includes slots which hold the contact members; and the antenna connector is soldered to the circuit board.

55. A communication unit in accordance with claim 54 wherein:

at least one of the contact members engages the antenna at a point of contact thereon which is not the recess of the antenna.

56. A communication unit in accordance with claim 55 wherein:

the contact members are flexible and are bent during attachment of the antenna to the antenna connector.

57. A communication unit in accordance with claim 56 wherein:

the contact members have a closed end part which provides electrical connection to contact locations on the antenna and are in contact with contact pads on the printed circuit board through the slots.

58. A communication unit in accordance with claim 55 wherein:

the contact members have a closed end part which provides electrical connection to contact locations on the antenna and are in contact with contact pads on the printed circuit board through the slots.

59. A communication unit in accordance with claim 54 wherein:

the contact members are flexible and are bent during attachment of the antenna to the antenna connector.

60. A communication unit in accordance with claim 59 wherein:

the contact members have a closed end part which provides electrical connection to contact locations on the antenna and are in contact with contact pads on the printed circuit board through the slots.

61. A communication unit in accordance with claim 54 wherein:

the contact members have a closed end part which provides electrical connection to contact locations on the antenna and are in contact with contact pads on the printed circuit board through the slots.

62. A communication unit in accordance with claim 53 wherein:

at least one of the contact members engages the antenna at a point of contact thereon which is not the recess of the antenna.

63. A communication unit in accordance with claim 62 wherein:

the contact members are flexible and are bent during attachment of the antenna to the antenna connector.

64. A communication unit in accordance with claim 63 wherein:

the contact members have a closed end part which provides electrical connection to contact locations on the antenna and are in contact with contact pads on the printed circuit board through the slots.

65. A communication unit in accordance with claim 62 wherein:

the contact members have a closed end part which provides electrical connection to contact locations on the antenna and are in contact with contact pads on the printed circuit board through the slots.

66. A communication unit in accordance with claim 53 wherein:

the contact members are flexible and are bent during attachment of the antenna to the antenna connector.

67. A communication unit in accordance with claim 66 wherein:

the contact members have a closed end part which provides electrical connection to contact locations on the antenna and are in contact with contact pads on the printed circuit board through the slots.

68. A communication unit in accordance with claim 53 wherein:

the contact members have a closed end part which provides electrical connection to contact locations on the antenna and are in contact with contact pads on the printed circuit board through the slots.

69. A communication unit in accordance with claim 53 wherein:

the antenna connector includes a number of slots greater than a number of contact members with some of the slots holding contact members contacting the contact pads.

70. A communication unit in accordance with claim 53 wherein:

the antenna connector includes a number of slots greater than a number of contact members with some of the slots holding contact members contacting the contact pads.

71. A communication unit in accordance with claim 53 wherein:

the antenna connector includes a connection which receives a testing probe.

72. A communication unit in accordance with claim 53 wherein:

the antenna connection is elongated.

* * * * *